US011444384B2

(12) United States Patent
Fraysse et al.

(10) Patent No.: US 11,444,384 B2
(45) Date of Patent: Sep. 13, 2022

(54) MULTIPLE-PORT RADIATING ELEMENT

(71) Applicant: THALES, Courbevoie (FR)

(72) Inventors: Jean-Philippe Fraysse, Toulouse (FR); Charalampos Stoumpos, Salonika (GR); Hervé Legay, Plaisance du Touch (FR); Ségolène Tubau, Toulouse (FR)

(73) Assignee: THALES, Courbevoie (FR)

( * ) Notice: Subject to any disclaimer, the term of this patent is extended or adjusted under 35 U.S.C. 154(b) by 297 days.

(21) Appl. No.: 16/700,897

(22) Filed: Dec. 2, 2019

(65) Prior Publication Data

US 2020/0176878 A1 Jun. 4, 2020

(30) Foreign Application Priority Data

Dec. 3, 2018 (FR) ..... 1872213

(51) Int. Cl.
*H01Q 13/02* (2006.01)
*H01Q 21/00* (2006.01)
*H01Q 21/06* (2006.01)

(52) U.S. Cl.
CPC ..... *H01Q 13/025* (2013.01); *H01Q 13/0225* (2013.01); *H01Q 21/0006* (2013.01); *H01Q 21/064* (2013.01)

(58) Field of Classification Search
CPC .. H01Q 1/288; H01Q 13/0225; H01Q 13/025; H01Q 21/0006; H01Q 21/064; H01P 1/16
See application file for complete search history.

(56) References Cited

U.S. PATENT DOCUMENTS 4,357,612 A * 11/1982 Salvat ..... H01P 1/16 343/772
6,211,838 B1 4/2001 Cherrette et al.
2019/0097296 A1 3/2019 Fraysse et al.

FOREIGN PATENT DOCUMENTS

EP 1 930 982 A1 6/2008
FR 2 477 785 A1 9/1981
FR 2 739 226 A1 3/1997
FR 3 012 917 A1 5/2015

OTHER PUBLICATIONS

Albert, et al., "Design, manufacturing and test of a spline-profile square horn for focal array applications", 2012 15 International Symposium on Antenna Technology and Applied Electromagnetics, 2012.
Toso, et al., "Multibeam antennas based on phased arrays: An overview on recent ESA developments", The 8th European Conference on Antennas and Propagation (EuCAP 2014); 2014.

* cited by examiner

*Primary Examiner* — Robert Karacsony
(74) *Attorney, Agent, or Firm* — BakerHostetler

(57) ABSTRACT

A radiating element includes at least two feeding guides and one horn common to at least two feeding guides and having an excitation interface, each feeding guide comprising a port guide and an excitation guide connected to the port guide by a port interface and connected to the common horn by the excitation interface, each excitation guide being flared in the direction from the port interface to the excitation interface, each excitation guide not having an axis of symmetry, the two feeding guides being disposed symmetrically relative to one another.

16 Claims, 12 Drawing Sheets

MULTIPLE-PORT RADIATING ELEMENT

CROSS-REFERENCE TO RELATED APPLICATIONS

This application claims priority to foreign French patent application No. FR 1872213, filed on Dec. 3, 2018, the disclosure of which is incorporated by reference in its entirety.

FIELD OF THE INVENTION

The invention relates to the general field of antennas, in particular the satellite antennas, in particular the active antennas, the array antennas or the multi-beam antennas. Such antennas comprise several radiating elements, and the invention relates more specifically to radiating elements with compact multiple ports and with high radiation efficiency.

BACKGROUND

An array antenna is composed of radiating elements which must observe certain characteristics. They must in particular have a radiating surface whose maximum dimensions depend on the operating frequency and on the angular deviation desired between the main lobe generated by the antenna and its array lobes. By taking account of these dimensional constraints, they must exhibit the maximum surface efficiency, that is to say close to 100%. The surface efficiency characterizes the coefficient between the directivity of the radiating element and that which would be obtained by a radiating aperture occupying the space allotted to the radiating element, and on which a uniform distribution of the electrical field is imposed. Maximizing the surface efficiency of the radiating elements makes it possible to optimize the gain of the array antenna and to reduce the levels of the secondary lobes and of the array lobes.

By observing these constraints, for a given antenna surface, the gain will be maximized, and it will thus be possible to minimize the power of the amplifiers of the transmission antennas or to maximise the G/T ratio of the reception antennas.

The radiating elements must also have a small footprint and a low weight and/or the capacity to be excited in a compact manner in single or bi-polarization mode, and a bandwidth compatible with the targeted application.

Thus, a general problem that the invention seeks to resolve consists in designing radiating elements which make it possible to obtain at the output of the radiating aperture an electrical field that is as uniform as possible while observing the composed dimensioning constraints. In particular, each radiating element must be compact and exhibit a short profile.

Various solutions exist in the state of the art for designing radiating elements for satellite antennas. Generally, they all use metal structures in order to minimize the insertion losses.

FIG. 1 schematically represents a first example of radiating element 100 according to the prior art. The radiating element of FIG. 1 comprises a first port waveguide 101 and a second waveguide 102 in the form of a horn flared towards the radiating aperture. In the example of FIG. 1, the section of the horn is of square form. This known type of radiating element makes it possible to ensure a soft transition between the signal guided via the port guide 101 and the signal radiated at the output of the horn 102.

The radiating element 100 of FIG. 1 does however present the drawback of a low radiation efficiency because it does not make it possible to obtain an electrical field that is uniformly distributed over its aperture. Indeed, the structure of the horn 102 favours only the propagation of the fundamental mode of the wave excited at the port guide 101.

FIG. 2 schematically represents a profile cross-sectional view of the radiating element 100. The curve 103 schematically represents the distribution of the density of the electrical field radiated at the aperture of the horn 102. As indicated in FIG. 2, the maximum energy of the radiated electrical field is reached at the centre of the aperture whereas the energy decreases progressively from the centre to the edges of the aperture.

In order to try to obtain a distribution of the electrical field that is more uniform over the aperture of the radiating element, the profile of the horn can be modified in the manner described in the example of FIG. 3. In this example, the horn 302 no longer has a straight linear profile, but a corrugated profile or so-called "spline" profile. Such a profile involves producing corrugations on the wall of the horn 302 in order to excite and control the propagation of higher modes of the radiated wave inside the horn. This example is described in the publication (1). Using this type of profile, a suitable combination of the different modes of propagation of the wave is obtained on the radiating aperture of the horn 302 which leads to a more uniform distribution of the electrical field 302 as schematically represented in FIG. 3. However, the distribution of the electrical field is still not uniform because the energy decreases, on this image example, towards the centre of the aperture. In other variant embodiments of this type of horn, the electrical field can exhibit more than two energy maxima but, in all cases, the distribution of the electrical field is not uniform.

FIG. 4 schematically represents another example of radiating element 400 as described in the publication (2). In this example, an array of horns is used, each horn having a small aperture in order to obtain a better overall radiation efficiency for the radiating aperture of the antenna. The radiating element 400 is thus composed of several sub-elements each comprising a port guide 401,411 and a horn 402,412 of the type described in FIG. 1. A power splitter 404 ensures the uniform and in-phase feeding of the different sub-elements of the array. The distribution 403 of the density of the electrical field radiated at the aperture of the array of horns is still not uniform. It in particular exhibits a minimum close to zero at the centre of the distribution.

The solution of FIG. 4 offers the advantage of using radiating sub-elements of small aperture and which therefore have a length significantly less than that of a radiating element of the type of FIG. 1. This solution thus makes it possible to develop compact radiating elements. However, it does not make it possible to obtain a uniform distribution of the electrical field over the radiating aperture because, as schematically represented by the curve 403 in FIG. 4, the tangential electrical field is cancelled on the metal walls of this radiating element, and electrical field level minima are identified between the different horns 402,412 which penalizes the overall radiation efficiency. Another drawback of the solution of FIG. 4 is that it requires the use of a power splitter 404 connected to the radiating sub-elements to feed them in phase. The splitter 404 must observe the mesh of the antenna and be very compact in order not to penalize the overall profile of the antenna.

FIG. 5 schematically represents yet another example of radiating element 500 as described in the American patent U.S. Pat. No. 6,211,838. This solution consists of a radiating aperture array fed by a power splitter incorporated in the horn 502 in line with the flaring thereof. This solution exhibits a radiation efficiency comparable to that of the example of FIG. 4 with the same drawback of electrical field level minima between the different apertures as illustrated by the electrical field curve 503.

FIG. 6 schematically represents yet another example of radiating element 600 described in the French patent application FR3012917. In this example, the radiating element 600 is composed of several Fabry-Pérot cavities 603,613, 604 which are superposed, the whole being fed by several port guides 602,612. Each Fabry-Pérot cavity 603,613,604 is a metal cavity closed by a grating 606,616,626 which is configured to reflect a portion of the signal injected at the centre of the cavity towards its periphery. This approach makes it possible to obtain a better surface radiation efficiency than the solutions described previously, as illustrated by the electrical field curve 605. However, it presents the drawback of being difficult to apply over a wide frequency band while guaranteeing a good matching at the ports.

None of the solutions of the state of the art makes it possible to obtain a truly uniform electrical field density at the horn output while conserving a compactness that is necessary for active antenna applications.

SUMMARY OF THE INVENTION

The invention proposes a novel type of radiating element which relies on the excitation of a single radiating aperture by several ports. Contrary to a known array of radiating elements, the proposed radiating element comprises a horn common to all the ports which are coupled to the common horn at an excitation interface and via excitation guides.

The use of a horn common to several ports makes it possible to favour the excitation of the higher modes of the wave on the radiating surface contrary to a conventional radiating element array. In order to control the levels of excitation and of combination of the different propagation modes of the wave on the radiating aperture, the excitation guides operate also on several modes. The excitation and the control of these modes in the excitation guides are obtained notably by virtue of their dissymmetry.

The association of the excitation at several points of a radiating element (naturally allowing a more uniform distribution of the electrical field) with the numerous optimization parameters provided by the proposed solution makes it possible to more efficiently control the combination of the different propagation modes at the output of the radiating aperture over a shorter distance in the axis of propagation of the signal than the known solutions. It follows therefrom that the proposed solution makes it possible to develop radiating elements which are both very efficient and very compact.

The subject of the invention is a radiating element comprising at least two feeding guides and one horn common to at least two feeding guides and having an excitation interface, each feeding guide comprising a port guide and an excitation guide connected to the port guide by a port interface and connected to the common horn by the excitation interface, each excitation guide being flared in the direction from the port interface to the excitation interface, each excitation guide not having an axis of symmetry, the two feeding guides being identical and disposed symmetrically relative to one another relative to a plane of symmetry of the radiating element, and the flaring profile of each excitation guide is configured so as to control, in amplitude and in phase, the propagation modes of a radiating wave propagated from each port guide to the output of the horn, so that the electrical field obtained at the output of the horn is substantially uniform.

According to a particular aspect of the invention, the flaring profile of each excitation guide is configured so as to favour the propagation of a fundamental propagation mode and of a second order higher propagation mode in the excitation guide.

According to a particular aspect of the invention, the flaring profile of each excitation guide is configured so as to favour the propagation, in the horn, of several odd order propagation modes, from the fundamental propagation mode and from the second order higher propagation mode propagated in each excitation guide.

According to a particular aspect of the invention, the flaring profile of each excitation guide is configured so as to control the amplitude and the phase of each propagation mode propagated in the horn so that the electrical field resulting from the combination of all of the propagation modes propagated in the horn is uniform at the output of the horn.

According to a particular variant, the radiating element according to the invention comprises at least four feeding guides, the horn being common to four feeding guides, the four feeding guides being disposed symmetrically to one another relative to two orthogonal planes of symmetry.

According to a particular aspect of the invention, each feeding guide is configured so that the longitudinal axis of a port guide is off-centre relative to the centre of the aperture of the excitation guide connected to the excitation interface.

According to a particular variant, the radiating element according to the invention further comprises a power splitter for exciting the port guides in phase.

According to a particular aspect of the invention, a transverse section of the excitation guide is of square, rectangular or circular form.

According to a particular aspect of the invention, the radiating element offers operation in single-polarization or bi-polarization mode.

According to a particular aspect of the invention, each excitation guide exhibits a continuous or discontinuous flaring profile.

According to a particular aspect of the invention, the common horn is axisymmetrical.

According to a particular aspect of the invention, each excitation guide exhibits a flared profile on a first plane and an unchanging profile on a second plane orthogonal to the first plane.

Also a subject of the invention is a radiating device comprising at least four radiating elements according to one of the preceding claims and a secondary horn common to the four radiating elements and connected via an input interface to the apertures of the respective horns of each radiating element.

Also a subject of the invention is an antenna comprising a plurality of radiating elements or a plurality of radiating devices according to the invention.

BRIEF DESCRIPTION OF THE DRAWINGS

The attached drawings illustrate the invention.

DETAILED DESCRIPTION

Figure 1:
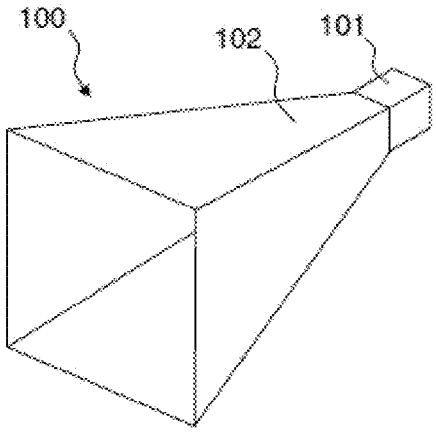
FIG.1 PRIOR ART
FIG. 1 represents a first example of radiating element according to the prior art.
Figure 2:
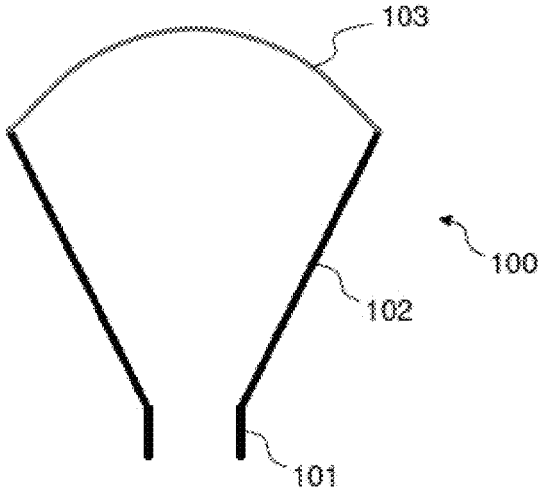
FIG.2 PRIOR ART
FIG. 2 represents a second example of radiating element according to the prior art.
Figure 3:
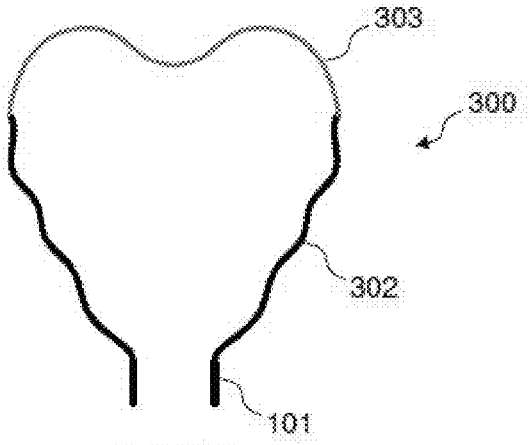
FIG.3 PRIOR ART
FIG. 3 represents a third example of radiating element according to the prior art.
Figure 4:
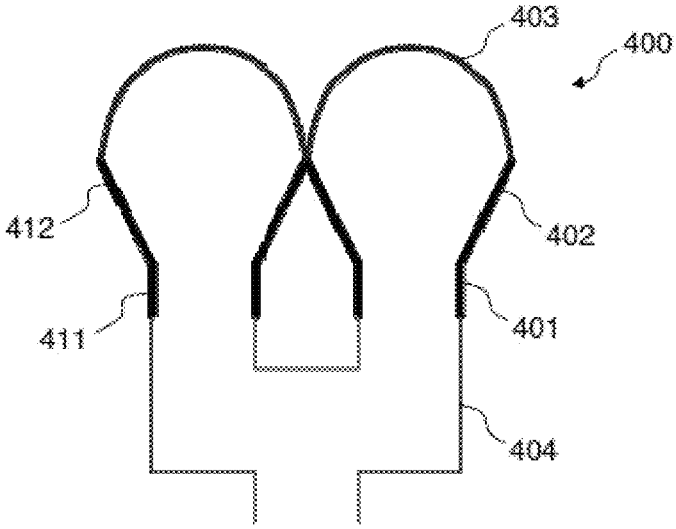
FIG.4 PRIOR ART
FIG. 4 represents a fourth example of radiating element according to the prior art.
Figure 5:
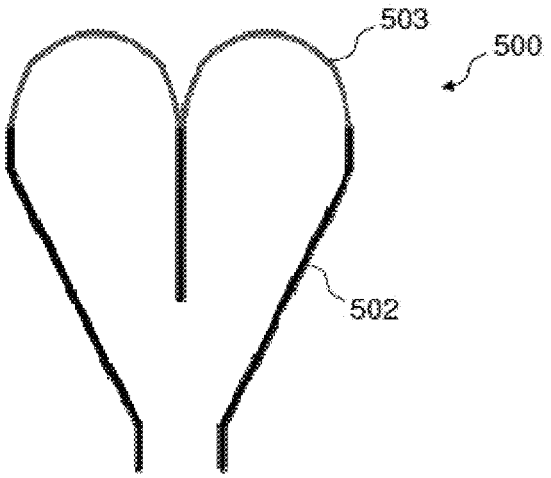
FIG.5 PRIOR ART
FIG. 5 represents a fifth example of radiating element according to the prior art.
Figure 6:
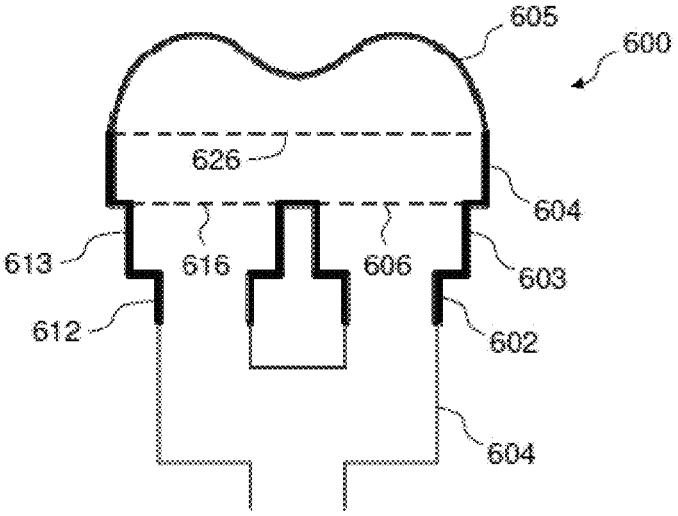
FIG.6 PRIOR ART
FIG. 6 represents a sixth example of radiating element according to the prior art.
Figure 7:
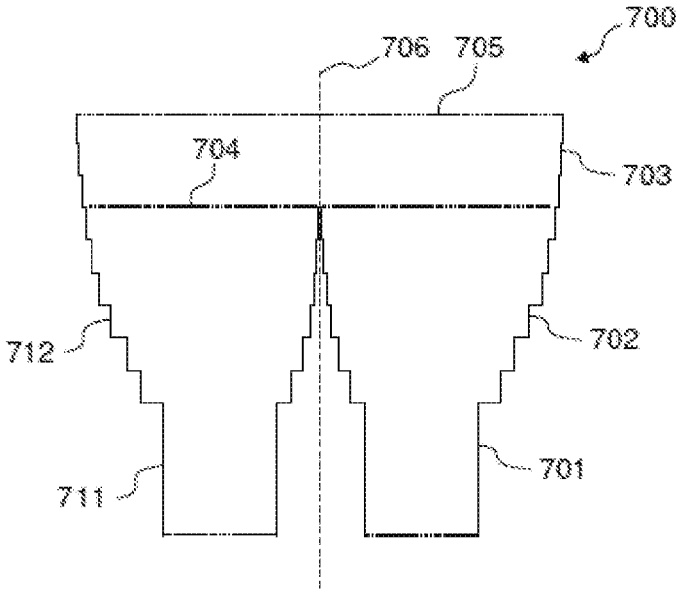
FIG. 7 represents a schematic profile view of an example of an antenna element according to an embodiment of the invention.

FIG. 7 represents a diagram, in profile view according to a longitudinal cross section, of an example of antenna element according to a first embodiment of the invention.

In this first embodiment, the antenna element 700 comprises two feeding guides coupled to a common horn 703 via an excitation interface 704. The common horn 703 is, for example, an axisymmetrical horn of square or rectangular or circular section, the choice of the section being made as a function of the dimensioning constraints of the array of antenna elements, in particular the mesh of the array. Each feeding guide comprises a port guide 701,711 coupled to an excitation guide 702,712. The port guides and the excitation guides are, for example, produced in waveguide technology. Each excitation guide is flared in the direction from the port guide to the excitation interface 704. As will be explained in more detail hereinbelow, an important feature of the antenna element is that each excitation guide has no axis of symmetry, in particular its longitudinal section (as represented in FIG. 7) is asymmetrical. Moreover, the two feeding guides are identical and disposed symmetrically relative to one another relative to a plane of symmetry 706 and coupled to the excitation interface 704 as illustrated in FIG. 7. The port guides 701,711 are, for example, guides of square or rectangular or circular section with a straight profile. The excitation guides 702,712 can, likewise, comprise a square, rectangular or circular profile but they exhibit an asymmetrical flaring profile. The flaring profile of an excitation guide is dimensioned so as to effectively excite and control a combination of the propagation modes of the wave at the output of the radiating aperture 705 of the common horn 703.

Figure 8:
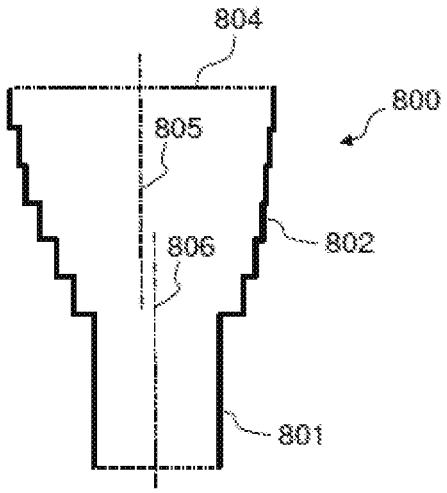
FIG. 8 represents a schematic profile view of a feeding guide of an antenna element according to an embodiment of the invention.

FIG. 8 schematically represents a profile view of a feeding guide 800 identical to one of the feeding guides described in FIG. 7. The feeding guide 800 represents the particular feature of having a dissymmetrical profile. More specifically, the axis 806 of symmetry of the port guide 801 is off-centre relative to the axis 805 passing through the centre of the aperture 804 of the excitation guide 802, the axis 805 being orthogonal to the excitation interface. In other words, the axis 806 of symmetry of the port guide 801 cuts the surface defined by the aperture 804 of the excitation guide at a point which is not the centre of the surface. Dissymmetrical profile is also understood to mean that the excitation guide 802 does not have an orthogonal axis of symmetry, unlike the horns usually used in the known solutions. In other words, a longitudinal section of an excitation guide (as represented in FIG. 8) has no axis of symmetry in the lengthwise direction. In particular, the axis 805 is not an axis of symmetry since the flaring profiles of the two sides of the axis 805 are not identical. The flaring profile of an excitation guide can be obtained by setting increasing values for the perimeters of the transverse sections of the guide along planes orthogonal to the view of FIG. 8 and which cut the axis 805 in a direction rising from the port guide 801 towards the excitation interface. The dissymmetry of the excitation guide means that the centres of the transverse sections of the excitation guide are not aligned on one and the same straight line at right angles to the sections. In some variant embodiments, the transverse section of the excitation guide can have a perimeter varying with values that increase overall in the direction of the axis 805 mentioned above although locally the perimeter can decrease slightly.

Figure 9:
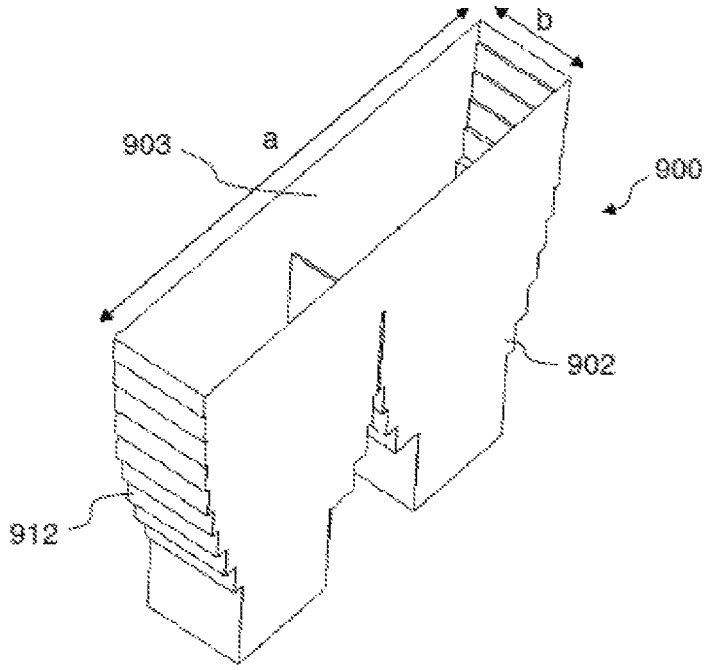
FIG. 9 represents a perspective view of an antenna element according to an embodiment of the invention.

FIG. 9 schematically represents a perspective view of a first example of a first exemplary embodiment of the antenna element according to the invention. This example is given in an illustrative and nonlimiting manner in order to explain how the flaring profile of an excitation guide is determined. In this example, the excitation guides 902,912 having a flaring profile according to a first plane and a straight profile according to a second plane orthogonal to the first plane. Thus, the radiating aperture of the horn 903 is of rectangular form of length a and of width b. In this example, an excitation guide 902,912 has no axis of symmetry, that is to say that it does not exhibit invariance when rotated by an angle of 180° although it does have a plane of symmetry parallel to the side a.

As explained in the preamble, a general objective of the invention is to obtain, on the radiating aperture 903 of the radiating element 900, a uniform distribution of the electrical field of the radiated wave.

There now follows an explanation, for the particular example of FIG. 9, of how the particular arrangement of the radiating element, and in particular the form of the excitation guides 902,912, makes it possible to tend towards a uniform distribution of the electrical field on the radiating aperture 903.

In the example of FIG. 9, the width b of the horn is less than λ/2, λ A being the wavelength of the signal. With this configuration, only the transverse electrical propagation modes $TE_{m0}$ are propagated in the horn, that is to say the components of the electrical field which are parallel to the side of the horn of width b. Indeed, the propagation modes $TE_{0n}$ corresponding to components of the electrical field parallel to the side of length a cannot be propagated.

It is recalled that the cutoff wavelength of a propagation mode $TE_{mn}$ is given by the relationship:

[Math. 1]

$$(\lambda_c)_{mn} = \frac{2}{\sqrt{\left(\frac{m}{a}\right)^2 + \left(\frac{n}{b}\right)^2}} \quad \text{(Eq. 1)}$$

Figure 10:
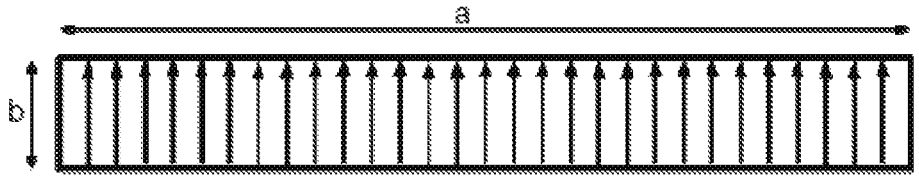
FIG. 10 represents a schematic view of a uniform electrical field over the radiating aperture of the antenna element of FIG. 9.

FIG. 10 represents, schematically, the radiating aperture of the antenna element of FIG. 9 with a uniform distribution of the electrical field over all the aperture. This uniform distribution is represented by arrows of identical thickness which reflect transverse components of the electrical field that are of the same intensity. FIG. 10 represents the distribution of the electrical field desired over the radiating aperture.

Figure 11:
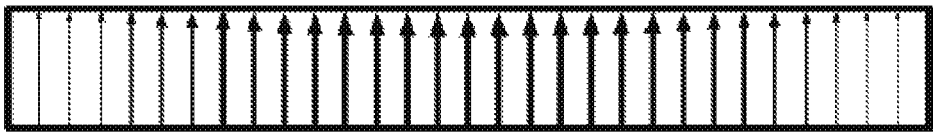
FIG. 11 represents a schematic view of an electrical field resulting only from the propagation of a fundamental mode $TE_{10}$.

FIG. 11 represents a distribution of the electrical field over the same radiating aperture but this time considering that only the fundamental mode $TE_{10}$ is propagated. In this particular case, the energy of the electrical field exhibits a higher level at the centre of the aperture than on the edges as is represented in FIG. 11 through arrows whose thickness, which reflects the intensity of the electrical field, decreases from the centre to the edges of the aperture, each arrow representing a transverse component of the electrical field. Thus, it can be seen that it is not possible to obtain a uniform distribution of the electrical field if only the mode $TE_{10}$ is propagated.

Figure 12:
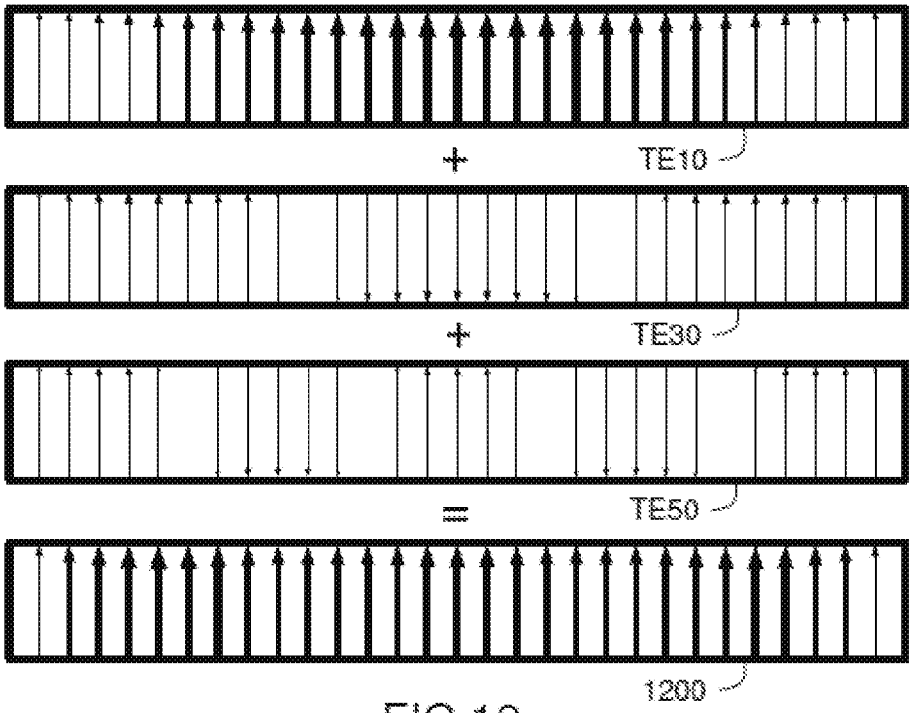
FIG. 12 represents a schematic view of a desired combination of the components of the modes $TE_{10}$, $TE_{30}$ and $TE_{50}$ to obtain a substantially uniform electrical field.

FIG. 12 schematically represents a combination of several modes making it possible to obtain a substantially uniform distribution 1200 of the electrical field. This involves combining, in phase, several modes $TE_{m0}$, with m being an odd integer, with an amplitude ratio equal to 1/m between the higher mode $TE_{m0}$, m being at least equal to 3, and the fundamental mode $TE_{10}$. Ideally, to achieve a strictly uniform electrical field, it would be necessary to combine an infinity of modes $TE_{m0}$, m being odd and varying from 1 to infinity. However, each higher mode is associated with a decreasing cutoff wavelength $(\lambda_c)_{mn}$ (given by the relationship (Eq. 1)). Thus, the modes whose cutoff wavelength is higher than the wavelength of the signal cannot be propagated. Also, the number of modes that can be propagated is limited by the dimensions (a,b) of the horn. For example, for a rectangular aperture of length a=2.6λ (with λ the wavelength of the signal), only the odd modes with m less than or equal to 5 can be propagated. Thus, in the example of FIG. 12, the modes $TE_{10}$, $TE_{30}$ and $TE_{50}$ must be combined in phase with an amplitude ratio equal to ⅓ between the third order higher mode and the fundamental mode and an amplitude ratio equal to ⅕ between the fifth order higher mode and the fundamental mode. FIG. 12 illustrates, on a diagram, the distribution of the electrical fields of the modes $TE_{10}$, $TE_{30}$ and $TE_{50}$, as well as the result 1200 of the abovementioned comparison. The direction of the arrows gives the orientation of the electrical field.

The invention consists, in particular, in generating and controlling the level of the fundamental mode and of the odd order higher modes at the output of the common horn to obtain a substantially uniform electrical field 1200 over the radiating aperture. To achieve this result, the common horn is excited via an excitation interface fed by several excitation guides which each favour the propagation of several modes.

Figure 13:
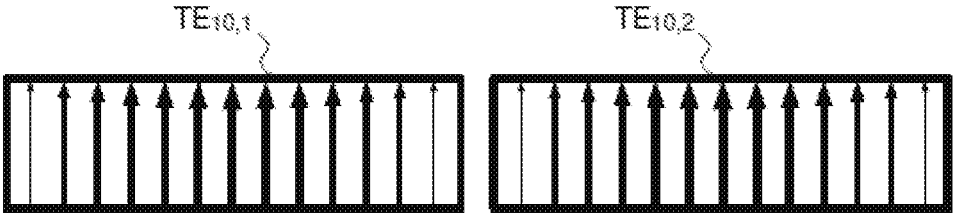
FIG. 13 represents a schematic view of the components of a fundamental mode of the electrical field generated in the waveguides of the antenna element.

Returning to the example of FIG. 7, there now follows a more detailed description of the operation of the propagation of the different modes of propagation of the electrical field in the antenna element. The port guides 701,711 are fed in phase via an excitation feed (not represented in FIG. 7). The port guides 701,711 are dimensioned so that only the fundamental modes $TE_{10}$ are propagated in the port guides. For example, the port guides 701,711 are waveguides having a rectangular section and a straight profile, the section being dimensioned in such a way that only the fundamental modes can be propagated. FIG. 13 schematically represents the electrical fields corresponding to the fundamental modes $TE_{10,1}$,$TE_{10,2}$ respectively observed at the output of the first port guide 701 and of the second port guide 711. These fundamental modes are excited in phase.

Figure 14:
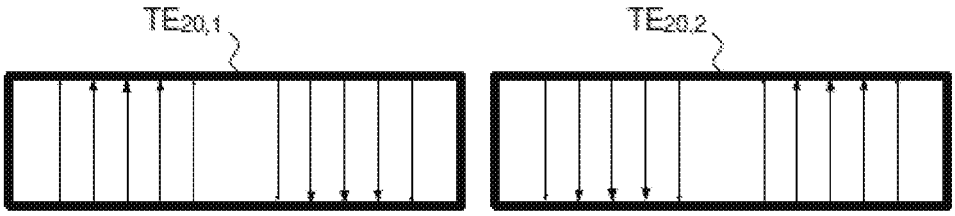
FIG. 14 represents a schematic view of the components of a second order mode of the electrical field generated in the excitation guides of the antenna element.

The progressive flaring of the excitation guides 702,712 then allows the second order higher mode $TE_{20}$ to be propagated. Thus, from the fundamental modes $TE_{10,1}$, $TE_{10,2}$ deriving from the port guides 701,711, a fundamental mode $TE_{10}$ and a second order higher mode $TE_{20}$, are propagated in each of the excitation guides 702,712. FIG. 14 schematically represents the electrical fields corresponding to the second order modes $TE_{20,1}$,$TE_{20,2}$ generated in the excitation guides 702,712. The second order modes $TE_{20,1}$, $TE_{20,2}$ are excitated in phase opposition because of the plane of symmetry 706 between the two excitation guides 702, 712. The propagation of the second order modes in the excitation guides 702,712 is promoted by the dissymmetrical form of the excitation guides and the misalignment between a port guide and the aperture of an excitation guide (as illustrated in FIG. 8).

From the fundamental and second order modes generated in the excitation guides 702,712, an appropriate combination of the odd order modes (in the present example, of the fundamental, third order and fifth order modes) is obtained in the common horn 703. Indeed, the odd order modes (for example second or fourth order) cannot be excited in the common horn because of the symmetry of excitation of the common horn which is linked to the symmetry of the antenna element relative to the plane 706. Indeed, the second order modes generated in the excitation guides are in phase opposition and require a dissymmetrical structure to be propagated. Naturally, they cannot be propagated in the common horn 703.

Thus, each of the modes $TE_{10,1}$, $TE_{10,2}$, $TE_{20,1}$, $TE_{20,2}$, generated in the excitation guides 702,712 makes it possible to generate modes $TE_{10}$, $TE_{30}$, $TE_{50}$, in the common horn 703 (notably because of the greater section of the common horn relative to the section of an excitation guide).

The levels of the modes $TE_{10}$, $TE_{30}$, $TE_{50}$ generated in the horn 703 from only the fundamental modes $TE_{10,1}$, $TE_{10,2}$ generated in the excitation guides 702,712 cannot in themselves observe the ratios ⅓ and ⅕ between these different modes to obtain a uniform electrical field.

By contrast, the controlled association of the modes $TE_{10}$, $TE_{30}$, $TE_{50}$ generated on the one hand from the fundamental modes $TE_{10,1}$, $TE_{10,2}$ and from the modes $TE_{10}$, $TE_{30}$, $TE_{50}$ generated on the other hand from the fundamental modes $TE_{20,1}$, $TE_{20,2}$, makes it possible to approach the desired amplitude ratios between the different modes: $|TE_{30}|/|TE_{10}|=1/3$ and $|TE_{50}|/|TE_{10}|=1/5$ and also allows a correct phase alignment of these different modes.

The control of the amplitudes and phase of the modes $TE_{10}$, $TE_{30}$, $TE_{50}$ generated in the horn 703 from the modes $TE_{10}$, $TE_{20}$ generated in the excitation guides 702,712 is obtained by the dissymmetrical flaring profile of an excitation guide. More specifically, the flaring profile can be obtained by numerical optimization by means of a software simulator making it possible to simulate the propagation of the different modes of the electrical field as well as their phase and their amplitude, as a function of the flaring profile. Thus, it is possible, by optimization, to determine the flaring profile which makes it possible to apply the combinations of modes described above.

The flaring profile of an excitation guide can be obtained by determining, for different points of the longitudinal axis of the excitation guide, the dimension of the section of the guide at that point, this dimension increasing with the flaring from the port guide to the excitation interface with the common horn.

Figure 15:
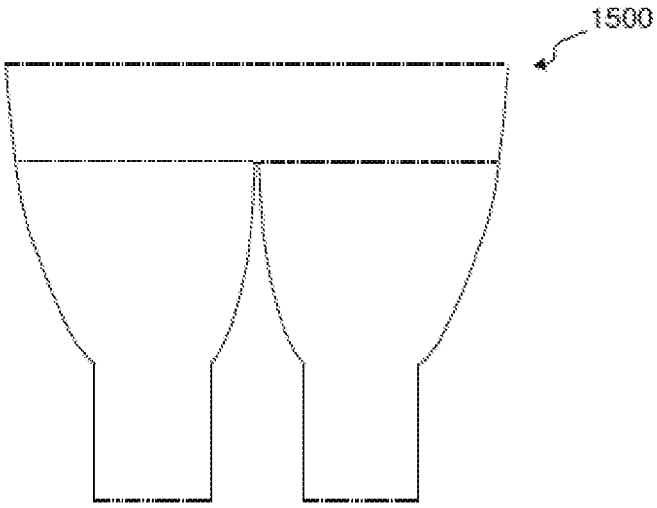
FIG. 15 represents a variant embodiment of the antenna element described in FIG. 7.

The flaring profile of an excitation guide can be obtained for a discrete number of sections, resulting in a discontinuous profile in the form of "treads" as illustrated in FIG. 7 or FIG. 9. But the profile can also be continuous as illustrated in FIG. 15 which represents a variant embodiment 1500 of the antenna element described in FIG. 7.

Figure 16:
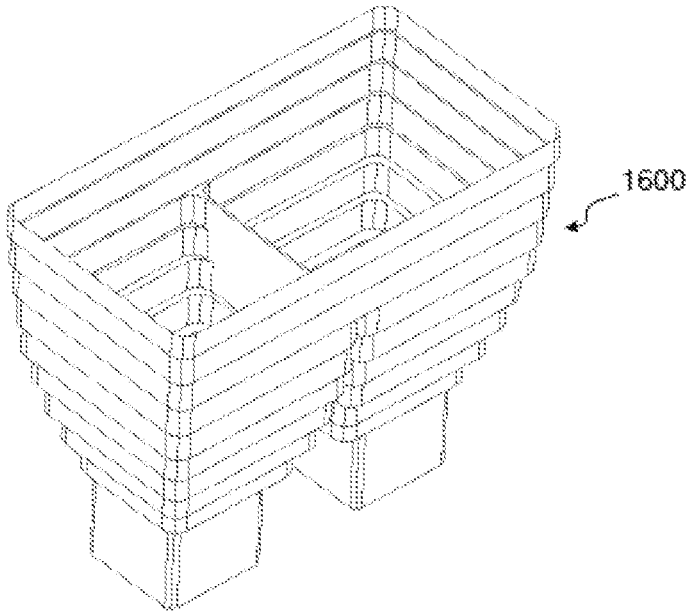
FIG. 16 represents a perspective view of another variant embodiment of the antenna element described in FIGS. 7 and 9.

In the example described in FIG. 9 which was used as the basis for the above explanations, the antenna element exhibits a flared and dissymmetrical profile only on one plane, with an unvarying straight profile on the other, perpendicular plane. In another embodiment illustrated in FIG. 16, the antenna element 1600 can also exhibit a flared and dissymmetrical profile on the two orthogonal planes in order to increase the radiation aperture.

Figure 17:
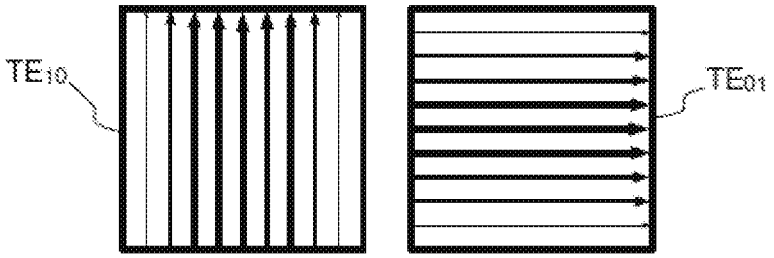
FIG. 17 represents a schematic view of the components of a fundamental mode of the electrical field generated in a port guide of square section.

In the example of FIG. 9, the section of an excitation guide is rectangular. However, the section of an excitation guide can also be square or circular then allowing the antenna element to operate in polarization mode. In this case, the excitation guides make it possible to propagate transverse modes $TE_{0n}$ in addition to the transverse modes $TE_{m0}$ described previously for the case of a guide of rectangular section. In other words, the electrical field can be propagated with modes in both right-angled directions as is illustrated in FIG. 17 for the case of the fundamental modes $TE_{10}$ and $TE_{01}$ and a square waveguide section.

According to a variant of the invention, the antenna element is not limited to a two-port operation as described hitherto. It can comprise a number greater than 2 of feeding guides, preferentially a number equal to a power of 2.

Figure 18:
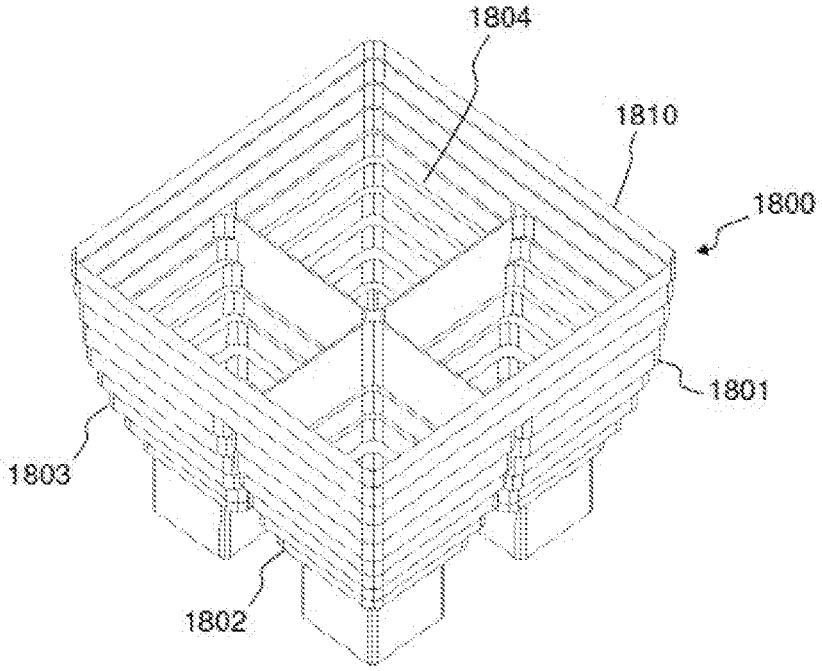
FIG. 18 represents a perspective view of yet another variant embodiment of the invention.

According to an embodiment of the invention described in FIG. 18, the antenna element 1800 can comprise four feeding guides 1801,1802,1803,1804, arranged symmetrically relative to two orthogonal planes of symmetry, and a common horn 1810. Each feeding guide comprises a port guide and a dissymmetrical excitation guide. One advantage of this embodiment is that it makes it possible to obtain a larger radiating aperture.

Figure 19:
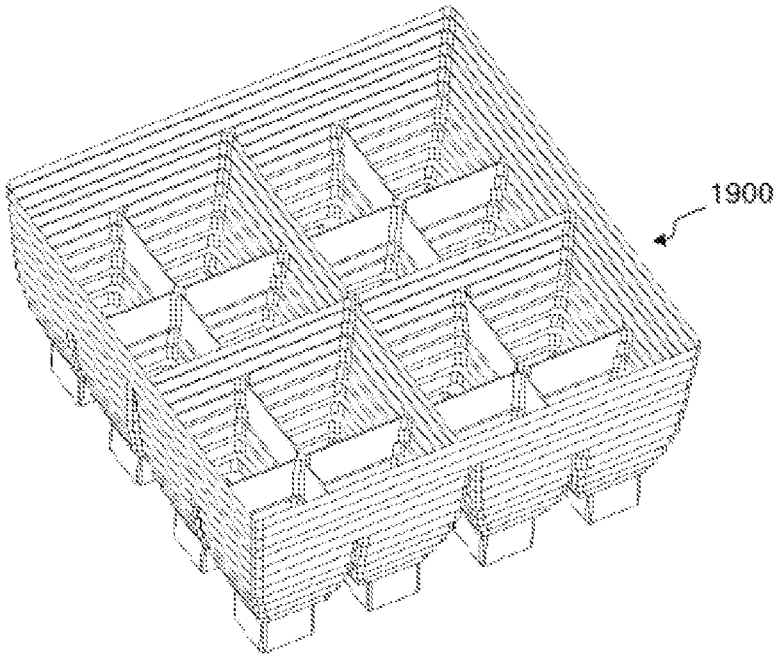
FIG. 19 represents a perspective view of yet another variant embodiment of the invention.

FIG. 19 describes yet another embodiment of the antenna element 1900, this time comprising 16 feeding guides disposed in groups of four. Each group of four feeding guides is arranged as on the antenna element 1800 of FIG. 19. The horn is common to the eight feeding guides allowing the radiating aperture to be further increased.

Figure 20:
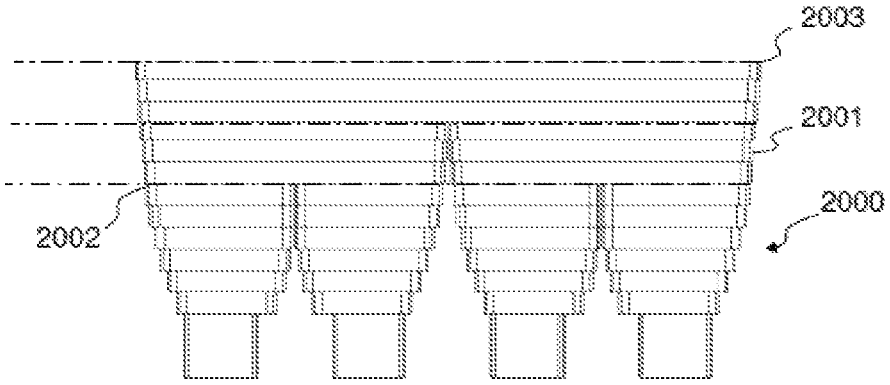
FIG. 20 represents a profile view of the variant embodiment of FIG. 19.

In a variant of the example of FIG. 19, advantageous for a large number of feeding guides, typically a number at least equal to 16, the common horn can be composed of several levels or stages. This principle is illustrated in FIG. 20 by a profile view of an antenna element with 16 feeding guides. The antenna element 2000 of FIG. 20 comprises a common horn composed of five individual horns, three of which are visible in the profile view of FIG. 20. Four individual horns 2001,2002 are positioned above the four sets of four feeding guides. Another individual horn 2003 is positioned above the four horns 2001,2002 of the first level. Thus, the horn 2003 of the second level combines the four horns 2001,2002 of the first level. The principle described in FIG. 20 can easily be extended to horns arranged on more than two levels. For example, if the antenna element comprises 16×4=64 feeding guides, it can comprise three levels of horns, a first level with sixteen horns each being common to four feeding guides, a second level with four horns and a third level with one horn.

Without departing from the scope of the invention, other arrangements are possible, notably concerning the number of feeding or port guides per antenna element.

As explained previously, to obtain an optimal operation of the multiple-port radiating element according to the invention, the port guides must be excited in phase. For that, a power splitter can be coupled to the inputs of the port guides.

Figure 21:
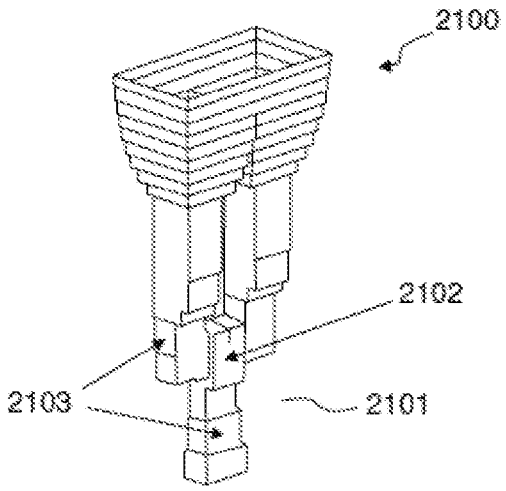
FIG. 21 represents another embodiment of the invention incorporating a power splitter.

FIG. 21 represents an example of antenna element 2100 with two ports and operating in mono-polarization mode. For this example, the in-phase excitation of the two port guides is produced by means of a power splitter 2101 which mainly comprises an H plane junction 2102 and matching sections 2103 to interface the H plane junction with, on the one hand, the port guides of the antenna element and, on the other hand, the excitation feed.

Figure 22:
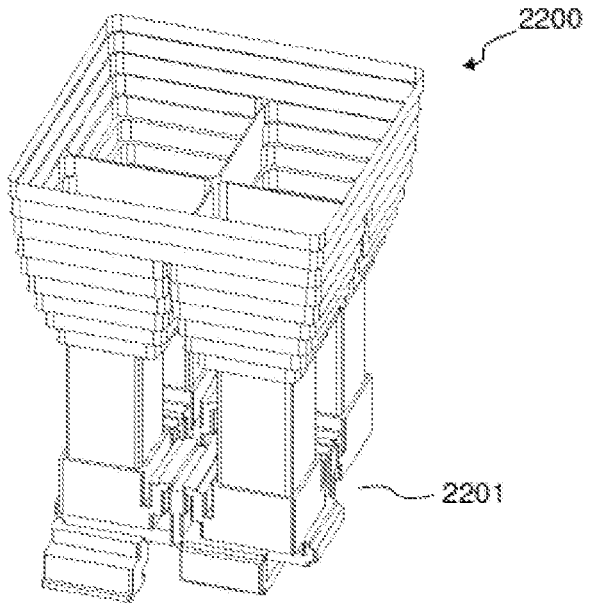
FIG. 22 represents a variant embodiment of the antenna element of FIG. 21.

FIG. 22 represents another example of antenna element 2200 with four ports operating in bipolarization mode. For this example, the four port guides are coupled to a power splitter 2201 which distributes to each port guide a fraction of signal of each of the two polarizations with the same amplitude and the same phase. An example of a power splitter suitable for fulfilling this function is a splitter comprising four orthomode transducers of the type described in the French patent application from the applicant filed under the number FR1700993.

In the examples described in FIGS. 21 and 22, the power splitter is separate from the antenna element and does not make it possible to generate higher order propagation modes.

Figure 23:
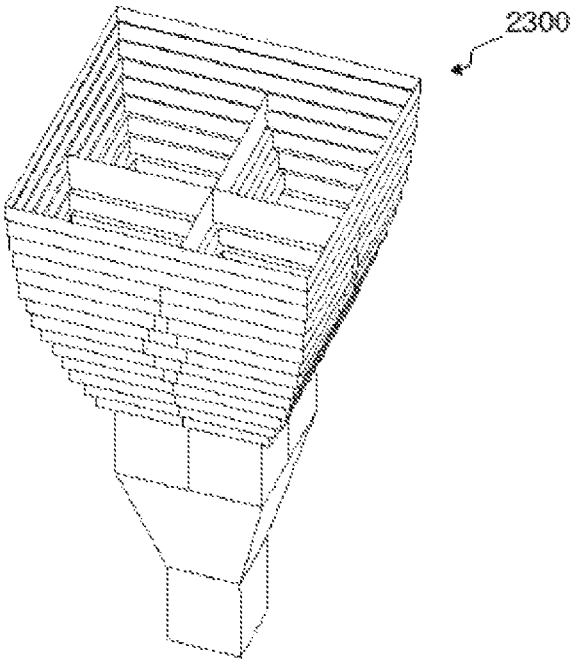
FIG. 23 represents yet another variant embodiment of the antenna element of FIG. 22.

In another embodiment described in FIG. 23, the power splitter is incorporated in the antenna element 2300. In other words, the functions of power distribution and excitation of the propagation modes are combined and ensured jointly by one and the same device in waveguide technology. One advantage of this embodiment is that it makes it possible to add more optimization parameters to the simulations allowing the accurate adjustment of the profile of the antenna element in order to obtain a uniform electrical field over the radiating aperture.

REFERENCES (1) Design, manufacturing and test of a spline-profile square horn for focal array applications Isabelle Albert; Maxime Romier; Daniel Belot; Jean-Pierre Adam; Pierrick Hamel, 2012 15 International Symposium on Antenna Technology and Applied Electromagnetics, Year: 2012

(2) Multibeam antennas based on phased arrays: An overview on recent ESA developments; Giovanni Toso; Piero Angeletti; Cyril Mangenot; The 8th European Conference on Antennas and Propagation (EuCAP 2014); Year: 2014

The invention claimed is:

1. A radiating element comprising at least two feeding guides distinct from one another, and one horn common to at least two feeding guides, and having an excitation interface, each feeding guide consisting of a port guide and an excitation guide connected to the port guide by a port interface and connected to the common horn by the excitation interface, each excitation guide being flared in the direction from the port interface to the excitation interface, each excitation guide not having an axis of symmetry, the two feeding guides being identical and disposed symmetrically relative to one another relative to a plane of symmetry of the radiating element.

2. The radiating element according to claim 1, wherein the flaring profile of each excitation guide is configured so as to control, in amplitude and in phase, the propagation modes of a radiating wave propagated from each port guide to the output of the horn, so that the electrical field obtained at the output of the horn is substantially uniform.

3. The radiating element according to claim 1, wherein the flaring profile of each excitation guide is configured so as to favour the propagation of a fundamental propagation mode and of a second order higher propagation mode in the excitation guide.

4. The radiating element according to claim 1, wherein the flaring profile of each excitation guide is configured so as to favour the propagation, in the horn, of several odd order propagation modes, from the fundamental propagation mode and from the second order higher propagation mode propagated in each excitation guide.

5. The radiating element according to claim 3, wherein the flaring profile of each excitation guide is configured so as to control the amplitude and the phase of each propagation mode propagated in the horn so that the electrical field resulting from the combination of all of the propagation modes propagated in the horn is uniform at the output of the horn.

6. The radiating element according to claim 1, comprising at least four feeding guides, the horn being common to four feeding guides, the four feeding guides being disposed symmetrically to one another relative to two orthogonal planes of symmetry.

7. The radiating element according to claim 1, wherein each feeding guide is configured so that the longitudinal axis of a port guide is off-centre relative to the centre of the aperture of the excitation guide connected to the excitation interface.

8. The radiating element according to claim 1, further comprising a power splitter for exciting the port guides in phase.

9. The radiating element according to claim 1, wherein a transverse section of the excitation guide is of square, rectangular or circular form.

10. The radiating element according to claim 1, wherein the radiating element offers operation in single-polarization or bi-polarization mode.

11. The radiating element according to claim 1, wherein each excitation guide exhibits a continuous or discontinuous flaring profile.

12. The radiating element according to claim 1, wherein the common horn is axisymmetrical.

13. The radiating element according to claim 1, wherein each excitation guide exhibits a flared profile on a first plane and an unchanging profile on a second plane orthogonal to the first plane.

14. A radiating device comprising at least four radiating elements according to claim 1 and a secondary horn common to the four radiating elements and connected via an input interface to the apertures of the respective horns of each radiating element.

15. An antenna comprising a plurality of radiating elements according to claim 1.

16. An antenna comprising a plurality of radiating devices according to claim 14.

* * * * *